US005178279A

United States Patent [19]

Carroll

[11] Patent Number: 5,178,279

[45] Date of Patent: Jan. 12, 1993

[54] NESTABLE DUNNAGE

[76] Inventor: Hazen J. Carroll, 7055 S. River Rd., Marine City, Mich. 48039

[21] Appl. No.: 800,681

[22] Filed: Dec. 2, 1991

Related U.S. Application Data

[63] Continuation of Ser. No. 488,240, Mar. 5, 1990, abandoned.

[51] Int. Cl.[5] ..... B65D 21/00

[52] U.S. Cl. ..... 206/499; 206/449; 206/521; 206/335

[58] Field of Search ..... 206/449, 499, 591-594, 206/521, 335

[56] References Cited

U.S. PATENT DOCUMENTS 2,844,268 7/1958 Lambert ..... 217/26.5
3,771,646 11/1973 Mascetti, Jr. ..... 206/65 K
4,349,109 9/1982 Scordato et al. ..... 206/562
4,501,355 2/1985 Hoffman ..... 206/77.1
4,921,101 5/1990 Gatt ..... 206/451

*Primary Examiner*—Jimmy G. Foster
*Assistant Examiner*—Thomas P. Hilliard
*Attorney, Agent, or Firm*—Brooks & Kushman

[57] ABSTRACT

Dunnage for automotive trim moldings comprises identical elongated, vacuum-formed strips each having upstanding, spaced apart posts and trim molding supporting bunks intermediate the posts with the bunks shaped to fit within trim moldings and support the Class A surfaces thereof spaced from the strip, and when corresponding ends of the strips are superimposed, the strips nest together in a compact space, and when the strips are reversed end-for-end, the posts support superjacent strips spaced vertically apart whereby the trim moldings are spaced from the superjacent strips.

7 Claims, 5 Drawing Sheets

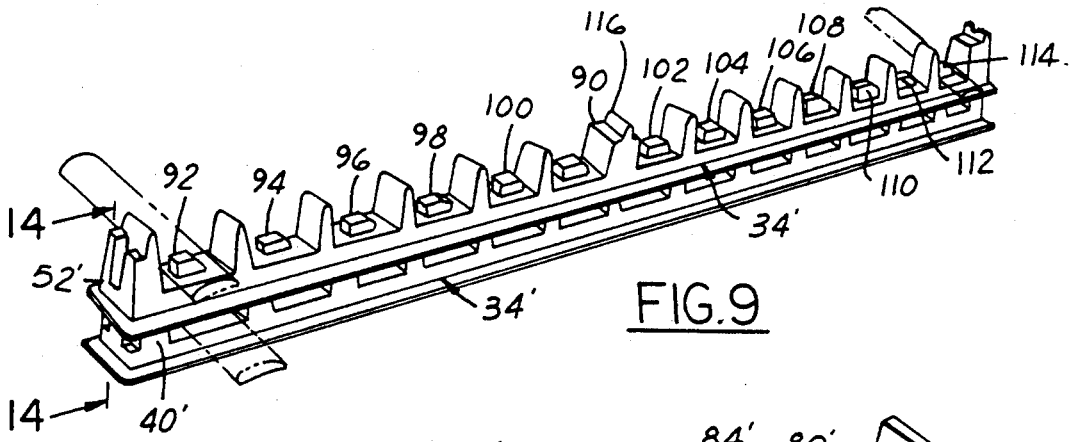
FIG.9
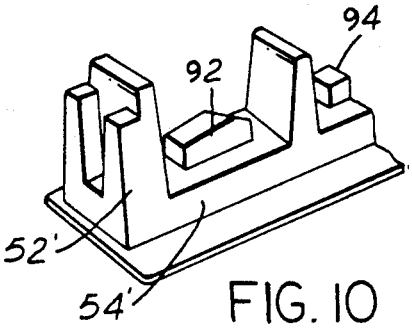
FIG. 10
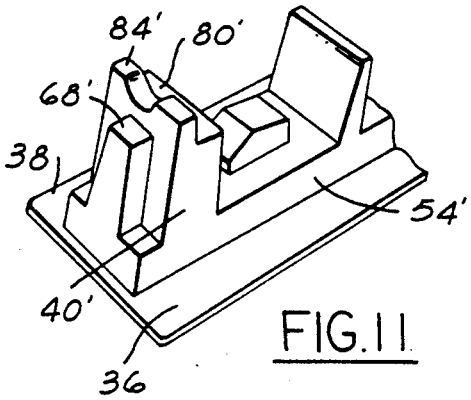
FIG.11
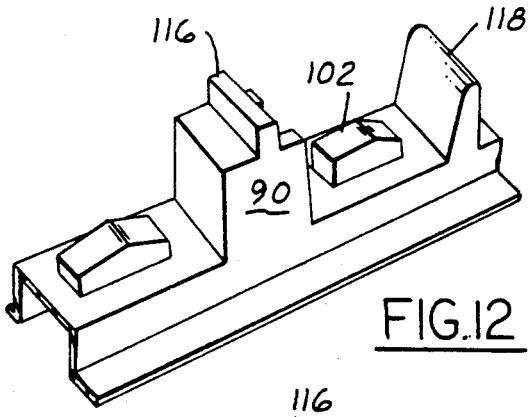
FIG.12
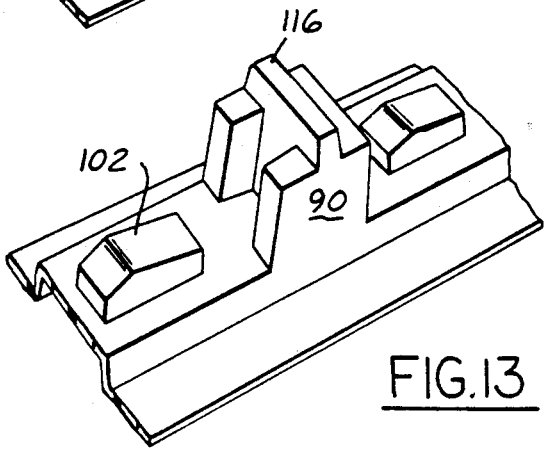
FIG.13
FIG.14
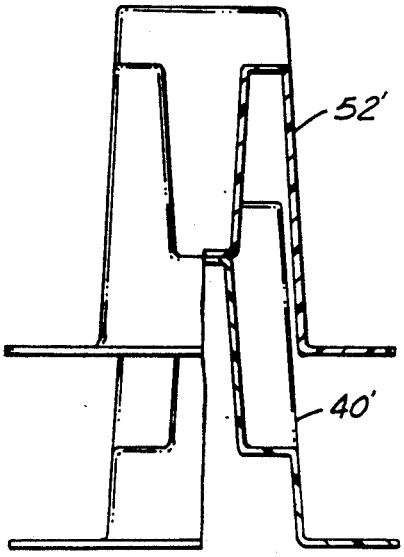

NESTABLE DUNNAGE

This is a continuation of application Ser. No. 07/488,240 filed Mar. 5, 1990, now abandoned.

FIELD OF INVENTION

This invention relates to vacuum-formed dunnage for storage and shipment of automotive trim and the like.

BACKGROUND OF INVENTION

A continuing problem in the manufacture of automobiles has been the damage-free handling of body trim moldings during shipment from the supplier to the assembly line and the storage at the line awaiting attachment to the vehicle body. Various types and designs of packaging or dunnage have heretofore been used but what has sufficed in the past is not sufficient to protect the latest forms of trim whose Class A surfaces can be easily scratched or marred. With the development of trim having Class A surfaces that can be easily scratched or marred, the problems of protecting such surfaces during shipment have increased.

Desirably, the nature of the dunnage to handle such trim should be such as to prevent contact of the Class A surfaces with either other trim pieces or with the dunnage itself to prevent scratching or marring of such surfaces. In addition, the dunnage should be as inexpensive as possible because it is used only once, and it should preferrably be capable of storage in a compact space when awaiting use to minimize shipping and storage costs when delivered from the dunnage maker to the automotive trim maker. The dunnage should be dimensionally stable and lightweight, and when in use, should allow the packaging of the maximum number of trim moldings in the most compact space.

SUMMARY OF THE INVENTION

I have found that the foregoing desirable features may be embodied in a vacuum-formed dunnage of high-impact styrene normally from 0.035" to 0.106" in thickness. The dunnage is formed in elongated strips shaped to provide upright, spaced apart posts between which are arranged trim receiving and supporting bunks. The posts and bunks are so designed that when the strips are arranged with corresponding ends superimposed, they may be compactly nested together, while arranged in an opposite end-for-end relation they may be stacked upon each other. In such stacked relation, the posts serve to support superjacent strips with the bunks vertically spaced apart to receive the trim molding thereon.

The post design is such that when the strips are arranged in their stacked relation, the posts serve to lock the strips against lateral or longitudinal displacement and the bunks serve to lock the trim moldings against lateral displacement. The dunnage strips or sections are intended to be placed in cartons or containers within which the trim is shipped. In one embodiment of the invention, the dunnage sections are arranged adjacent opposite ends of the container and the trim molding is placed on the dunnage sections to be supported by the bunks. After a first layer of dunnage and the supported trim moldings have been placed in the carton, a second layer of dunnage sections is stacked on the first sections and a second layer of trim molding is positioned on the second layer of dunnage sections. In like fashion, a carton is filled with layers of dunnage sections and trim moldings and a compact package of trim moldings is thus provided. The moldings are supported in the package in an almost floating relation to the carton with all Class A surfaces out of contact with the dunnage and adjacent trim moldings. As a result of the design, during shipment when the cartons may be jiggled and vibrated during transport, the Class A surfaces are kept from rubbing against the dunnage or other trim moldings and their surface appearance preserved.

BRIEF DESCRIPTION OF THE DRAWINGS

FIG. 9 is a perspective view of a modified form of two of my dunnage sections stacked for use with two automotive trim moldings held thereby for storage or transport;

FIGS. 10 and 11 are opposite ends of one of my dunnage sections of FIG. 9;

FIGS. 12 and 13 are perspective views of a fragment of my dunnage sections looking in opposite directions;

FIG. 14 is a cross-sectional view taken on the line 14—14 of FIG. 9;

BRIEF DESCRIPTION OF PREFERRED EMBODIMENTS

Figure 1:
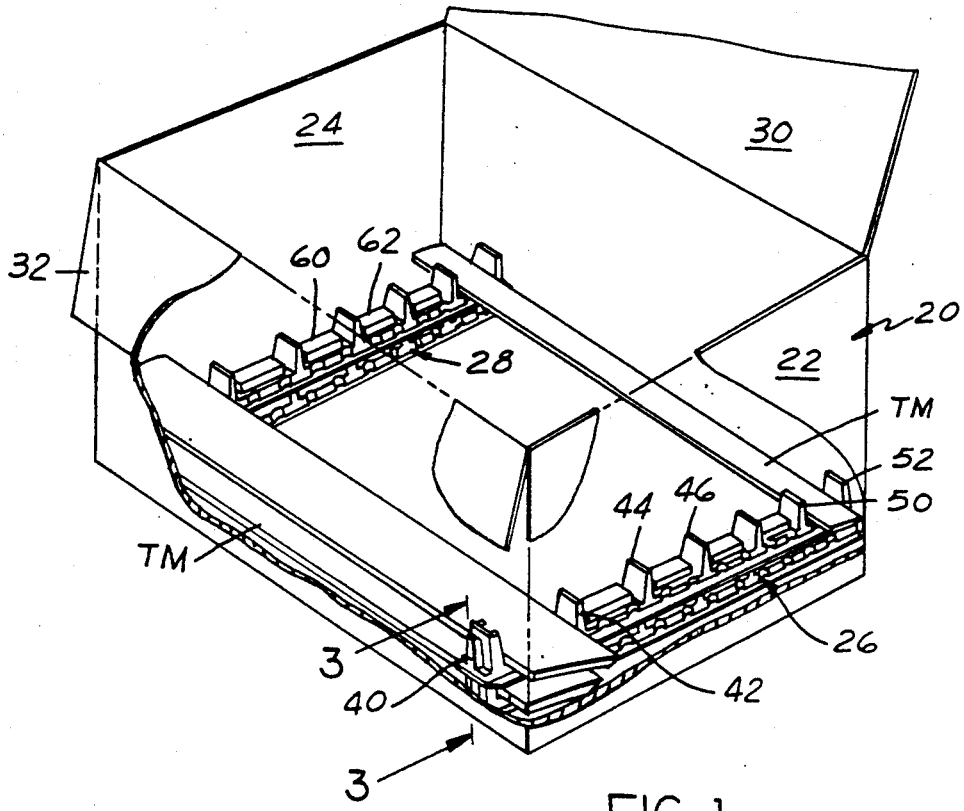
FIG. 1 is a perspective view of a shipping carton with sidewalls broken away for clarity showing automotive trim moldings packaged in layers therein by my improved dunnage.
Figure 2A:
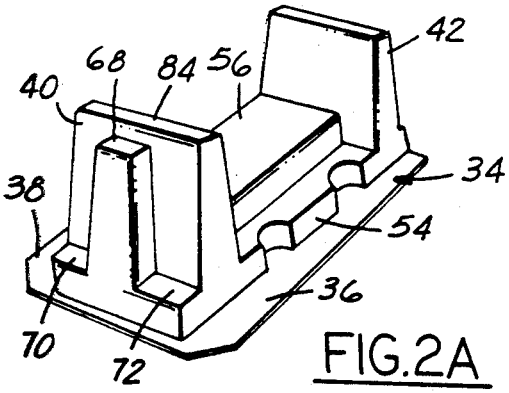
FIG. 2A is a perspective view of one end of a representative form of my improved dunnage.
Figure 2B:
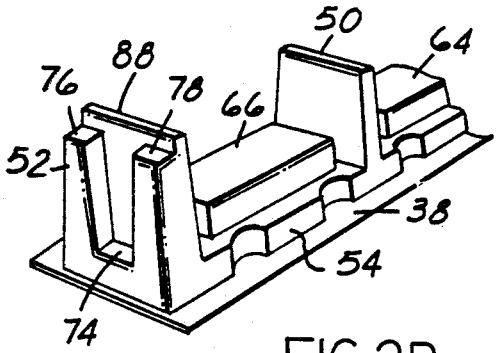
FIG. 2B is similar to FIG. 2A but shows the opposite end of the improved dunnage.
Figure 3:
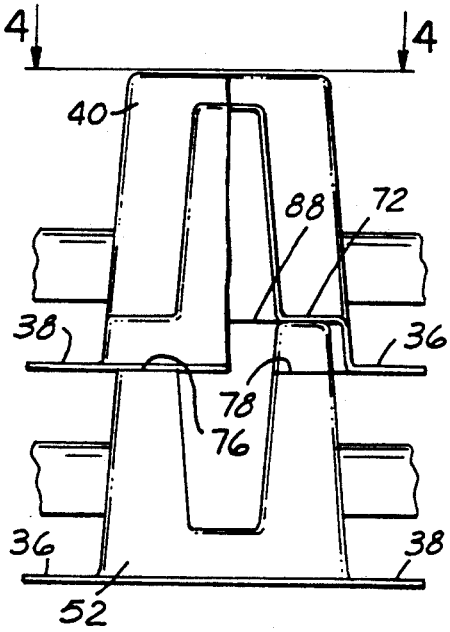
FIG. 3 is a fragmentary cross-sectional view through two stacked dunnage sections taken on the line 3—3 of FIG. 1.

Referring to FIG. 1, there is disclosed a shipping carton 20 intended to receive automotive trim moldings for shipment and storage. The carton may comprise a conventional cardboard box of generally rectangular form. Within the box, adjacent opposite ends 22 and 24, are positioned layers of dunnage 26 and 28 between which extend the trim moldings TM, only a few of which are shown for purposes of clarity. It will be understood that the layers of dunnage will extend from the bottom to the top of the carton adjacent the ends 22 and 2 thereof and the trim moldings will fill the carton while being supported by the dunnage. A layer of the dunnage (not shown) may be provided intermediate the layers 26 and 28 to support the centers of the trim moldings if there is an unacceptable sagging thereof.

Conventional lids or the like 30 and 32 will serve to close the top of the shipping carton.

It will be understood that the dunnage 26 and 28 is layered from the bottom to the top of the shipping carton and that the trim moldings extend between the layers of dunnage which in turn provides layers of trim moldings. The dunnage serves to space the trim moldings apart both vertically and horizontally. In addition, the dunnage is so designed as hereinafter disclosed that the exterior decorative surface, conventionally called the Class A surface, indicated at A is spaced from the dunnage and from other trim molding. This spacing of the Class A surface from the dunnage and other trim molding is a critical feature of this disclosure. The design of the dunnage which permits this spacing of the Class A surface from the surrounding dunnage and other trim molding provides what might be considered a floating suspension of the trim molding within the carton 20. Despite bumping, jarring and the like which may occur to the carton during shipment, the Class A surfaces of the trim moldings remain spaced from contact with dunnage and other trim molding which could mar or damage it.

The dunnage comprises identical vacuum-molded, elongated plastic strips or sections 34. The sections are made of high-impact styrene which is not only relatively inexpensive but dimensionally quite stable. In thickness it would normally be less than 0.100" and preferrably, for most applications, would lie in the range of 0.035" to 0.106". Other plastics having good dimensional stability and impact strength combined with low cost may be suitable, but the high-impact styrene has been found to be particularly advantageous.

Figure 5:
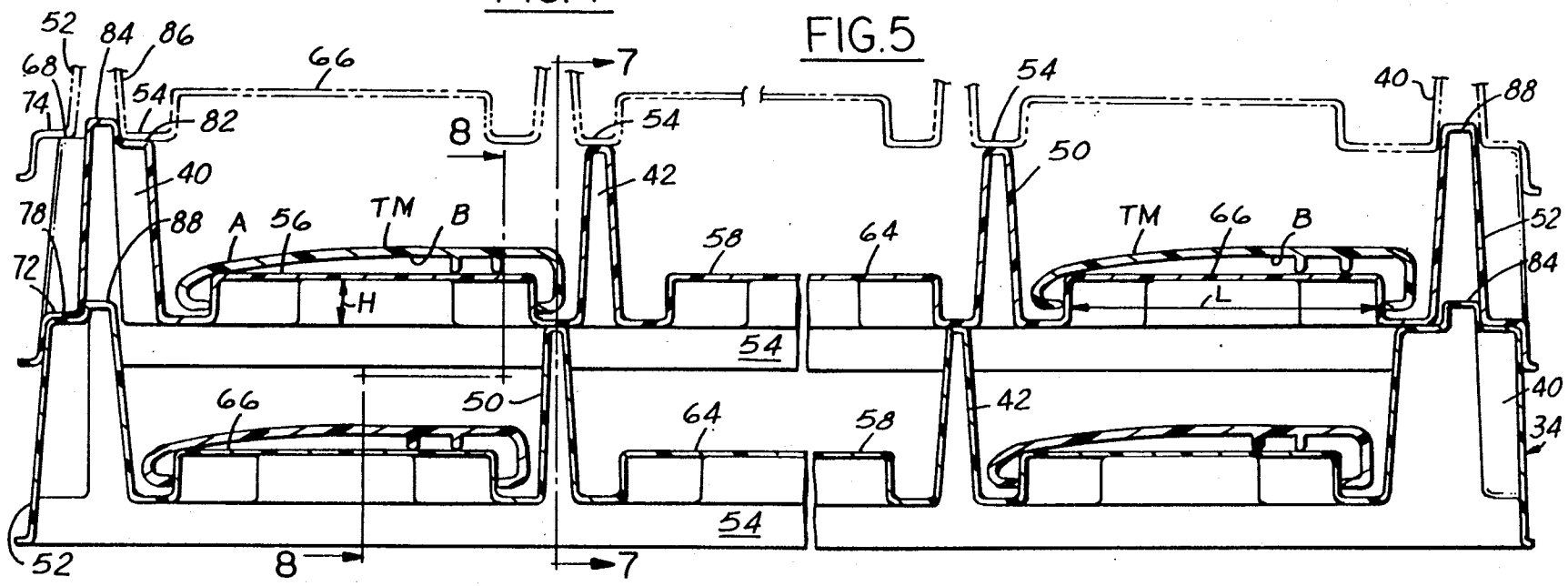
FIG. 5 is cross-sectional view taken along the line 5—5 of FIG. 4 and shows the dunnage in stacked relation and automotive trim moldings supported by my improved dunnage.
Figure 8:
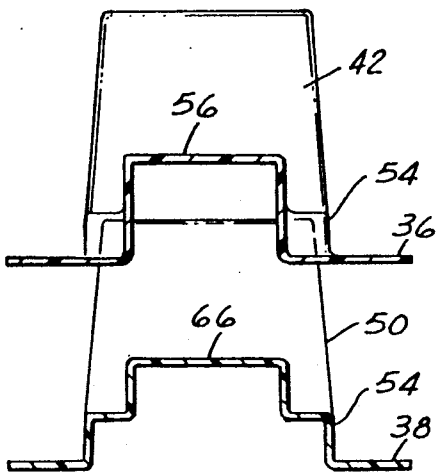
FIG. 8 is a cross-sectional view taken on the line 8—8 of FIG. 5.
Figure 7:
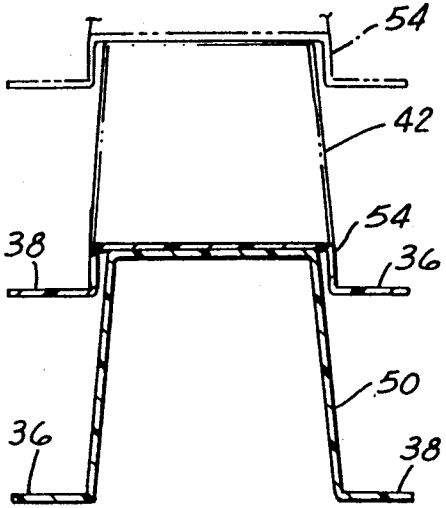
FIG. 7 is a cross-sectional view taken on the line 7—7 of FIG. 5.
Figure 15:
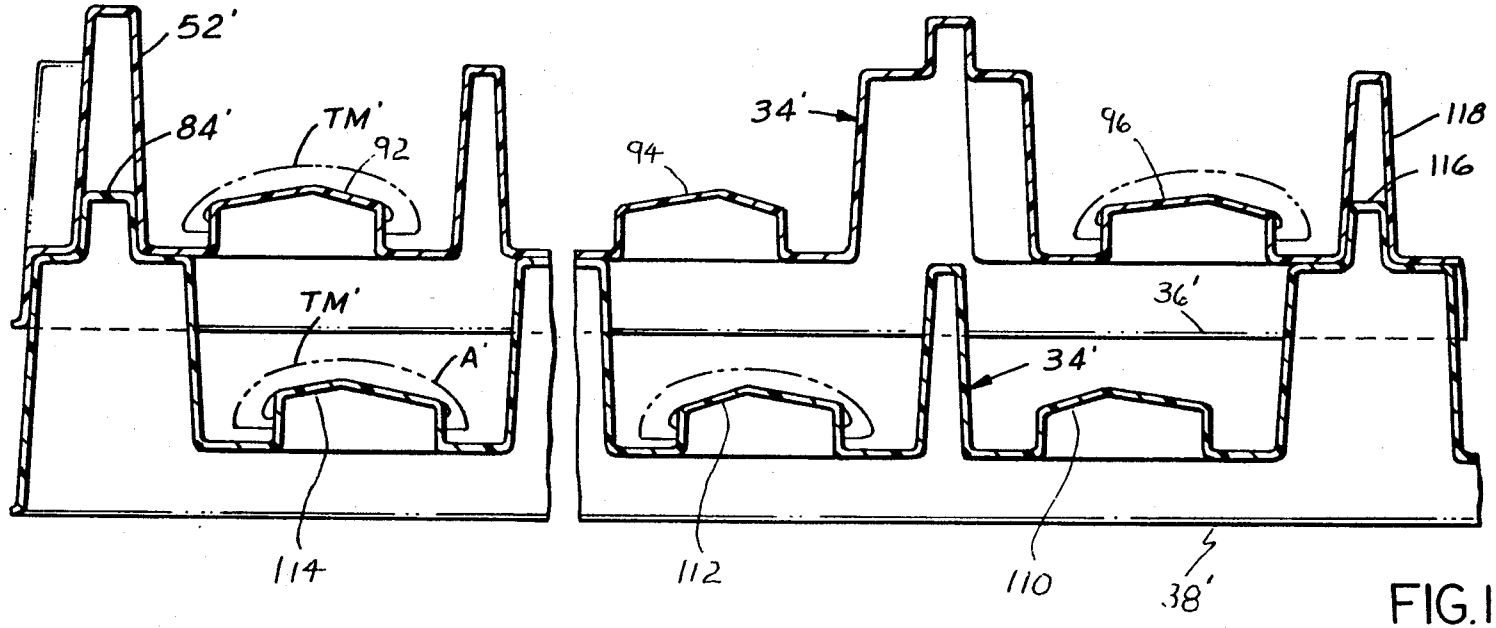
FIG. 15 is a longitudinal cross-sectional view of the dunnage of FIG. 9 showing the support of automotive trim moldings.

Each strip includes a pair of parallel-base flanges 36 and 38 which extend the full length of the strips or sections. These flanges serve to rigidify the strips and provide a flat base for supporting the bottom strip in the shipping carton. Each of the strips include a plurality of upstanding posts 40–52 inclusive, as indicated in FIG. 1, which are spaced apart along the length of the dunnage section by a distance slightly greater than the width of the trim molding to be supported thereby as best shown in FIG. 5. The posts are integral with a central raised rib 54 which extends substantially throughout the length of the dunnage sections and bridges between the flanges 36 and 38 and together with the flanges forming a hollow base. The channel-like structure shown in cross-section at FIGS. 7 and 8 provides a considerable rigidity for the dunnage sections despite their lightweight construction.

Intermediate the posts, the central rib 54 is provided with an integral, hollow trim molding receiving and supporting bunk indicated at 56–66 inclusive in the drawings. The height "H" and length "L" of the bunks are such as to be received within the inside of the trim molding and abutt the inner-surfaces, herein referred to as the Class B surfaces, identified by the letter B in the drawings, to support the trim molding with all of the Class A surfaces spaced from the dunnage section as best shown in FIG. 5. As the cross-sectional shape or configuration of the trim molding will vary from one style automobile to another, the bunks are shaped for each specific configuration of trim molding to be accommodated. Thus, the bunks shown in FIG. 5 are generally rectangular while those for other style trim molding such as hereinafter shown will be of a somewhat different shape. In each case, however, the bunk is designed to enter within and contact the Class B surfaces of the trim molding and support the molding with the Class A surfaces spaced from the adjacent portions of the dunnage. It has been found that even a soft, sponge-like material, if allowed to contact the Class A surfaces, can cause marring thereof as a result of vibration and jiggling of the shipping carton during transport of the molding from the molding maker to the vehicle assembly line. Accordingly, I have determined that a floating support of the molding as shown in FIG. 5 with all Class A surfaces spaced from the dunnage is the only wholly satisfactory way to avoid marring the surfaces through accidental contact and rubbing during transport of the trim moldings.

Figure 6:
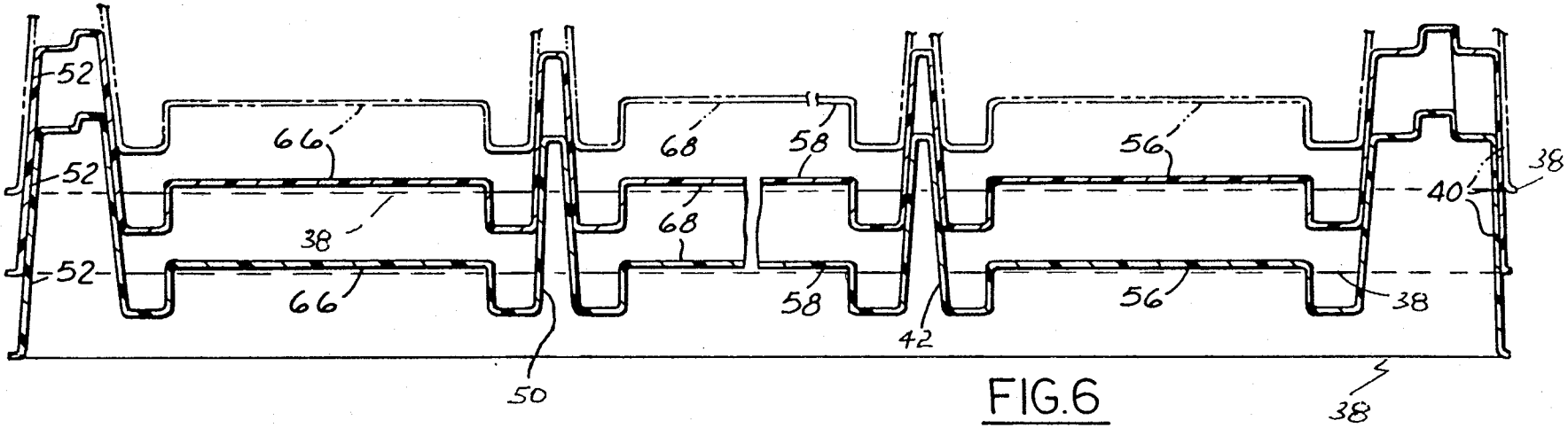
FIG. 6 is a cross-sectional view similar to FIG. 5 but with the trim moldings removed and the middle dunnage section of FIG. 5 reversed end-for-end whereby corresponding ends are superimposed and the sections nested together for storage prior to use.

The spaced apart posts 40–52 inclusive of the dunnage sections are so shaped and arranged that when corresponding ends of the dunnage sections are superimposed, the sections may be substantially nested together, as shown in FIG. 6, for storage or transport prior to use in supporting trim moldings in a shipping carton. On the other hand, when the dunnage sections are reversed end-for-end (vis., a superjacent strip is reversed end-for-end in relation to a subjacent strip, the posts are misaligned whereby the strips may be stacked as shown in FIG. 5 and the bunks are vertically spaced sufficiently from the superjacent strip to allow support of the trim moldings thereon without contact with the superjacent strip. The nesting as shown in FIG. 6 is facilitated by the vacuum-forming of the dunnage sections whereby the posts may nest together or inter-fit substantially. On the other hand, when the dunnage sections are reversed end-for-end as shown in FIG. 5, the misalignment of the posts causes the upper ends of the posts of a subjacent strip to bear against bottom surfaces of the central raised rib 54 to support the dunnage sections in the stacked vertically spaced arrangement shown.

Figure 4:
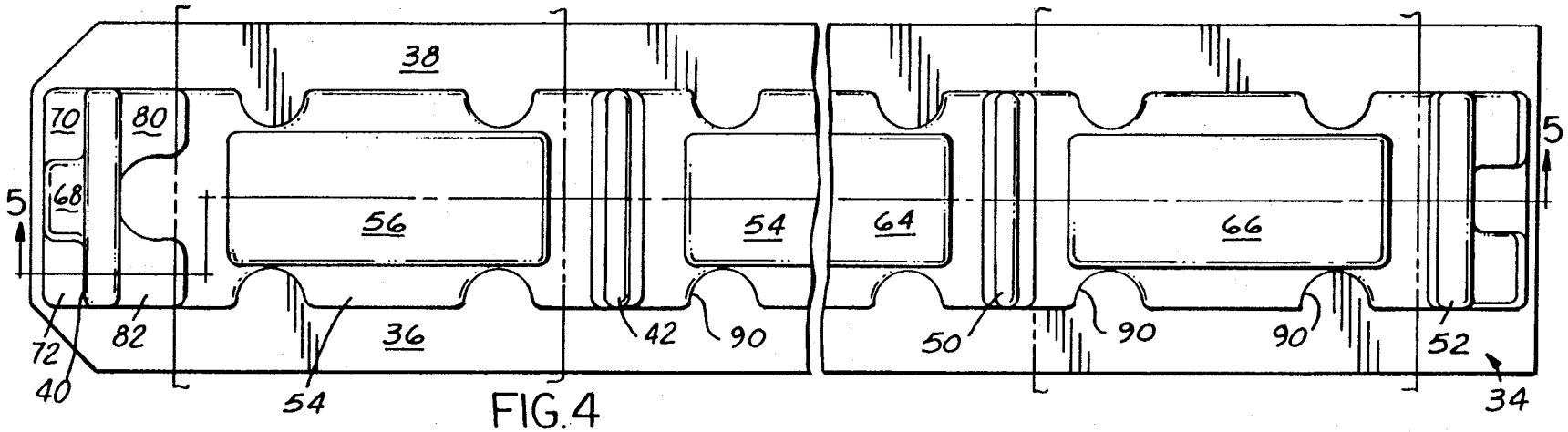
FIG. 4 is a top view of my improved dunnage taken along the line 4—4 of FIG. 3.

More specifically, posts 40 and 52 are provided with opposed, cooperating-supporting shoulders best shown in Figs. 2A, 2B, 3 and 5. Post 40 has supporting shoulder 68 providing an upwardly-facing surface and the hollow base has shoulders 70 and 72 providing two downwardly-facing surfaces. Shoulder 68 bears against the underside of shoulder 74 of the hollow base while the downwardly-facing surfaces of shoulders 70 and 72 bear at their undersides against the upwardly-facing surfaces of shoulders 76 and 78 formed on post 52 with the cooperation of the shoulders best shown in FIG. 5. As shown in FIG. 4, post 40 also has a pair of shoulders, 80 and 82, whose upwardly-facing surfaces bear against the underside the central raised rib 54, intermediate post 52 and the adjacent bunk 66. Similarly, the upper ends of the posts 42, 44, 46, 48 and 50 bear against the underside of the central raised rib 54 to support the superjacent dunnage section.

Post 40 has a rib-like portion 84 which projects above the shoulders 68, 80 and 82 and is received within the vacuum-formed cavity of post 52 to bear against vertical wall 86 to prevent longitudinal displacement of the stacked sections in one direction. Longitudinal shifting in the opposite direction is prevented by a rib-like portion 88 on post 52 which is received within the vacuum-formed cavity of post 40 of the superjacent dunnage section as best shown in FIG. 5. Relative lateral displacement of the stacked dunnage sections is also prevented by the rib-like portions 84 and 88 of the posts 40 and 52 respectively being received within the vacuum-formed cavities of the opposite posts of the superjacent dunnage sections. Thus, when in the operative stacked relation of FIG. 5, the strips are locked together against lateral or longitudinal displacement, the semi-circular cavities 90 formed by a semi-circular wall portion of the central raised rib 54 serve to rigidify the structure and/or provide for the accommodation of projecting portions of the trim molding. Thus, the dunnage sections may be stacked in operative position to accommodate the trim molding thereon and will serve to space the Class A surfaces of the trim moldings from adjacent surfaces of the dunnage and adjacent trim moldings.

In FIGS. 9–16, I have shown a modified form of the dunnage for holding a somewhat differently shaped trim molding and wherein the dunnage sections or strips 34' are longer and are provided intermediate their length with a locating post 90.

Figure 16:
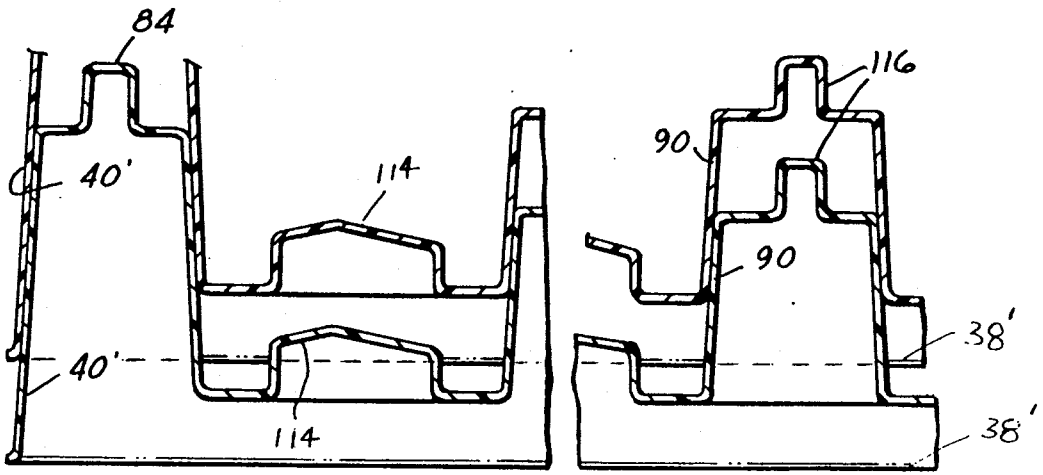
FIG. 16 is a view similar to FIG. 15 but with the trim moldings removed and showing the upper dunnage section of FIG. 15 reversed end-for-end and nested upon the lower section for storage of the dunnage.

In these figures of the drawings, parts generally corresponding to parts in FIGS. 1–8 utilize primed reference numerals and a specific description is thereby omitted unless otherwise noted. The bunks 92–114 inclusive are in principle the same as the bunks 56–66 inclusive except the configuration is slightly different to accommodate the somewhat differently shaped trim molding TM'. It will be noted particularly from FIG. 15 that when the strips 34' are in stacked relation, the bunks 92–114 serve to support the trim moldings similar to the earlier describe embodiment with the Class A surfaces spaced from adjacent surfaces of the dunnage. Because of the length of the dunnage sections of the FIG. 9–16 embodiment, I have provided a locating post 90, intermediate adjacent posts and about midway the length of the strip, having an upwardly projecting locating rib 94 which is received within the vacuum-formed cavity of the oppositely matching post 118. When the dunnage sections are reversed so that the corresponding ends are superimposed, the sections may be nested as shown in FIG. 16 for storage and shipment prior to use. The rib 116 on post 90 cooperates with the superjacent interior of post 118 to augment the locking action of the end posts 40' and 52' when the dunnage sections are in their stacked relationship shown in FIG. 15.

I claim:

1. Dunnage for the handling of products comprising, in combination:

a plurality of identical plastic sections each having a hollow base and a series of spaced apart upstanding hollow posts between which are product receiving and supporting bunks;

said base, posts and bunks being so arranged that, when corresponding ends of the sections are superimposed, the posts and bunks of a subjacent section may be telescoped substantially within the corresponding posts and base of the superjacent section; and said posts and hollow base having cooperating engaging surfaces which bear against each other when the superjacent section is reversed end-for-end and placed in operative position on the subjacent section with the posts of the subjacent section received within and engaging the hollow base of the superjacent section, and such surfaces serve to support the superjacent section spaced vertically from the bunks of the subjacent section, whereby products supported on the bunks of the subjacent section are disposed out of contact with the the superjacent section.

2. The invention defined by claim 1 wherein the posts and base have interfitting portions for locking the sections against lateral displacement when the sections are in operative positions.

3. The invention defined by claim 1 wherein the plastic sections are vacuum formed.

4. The invention defined by claim 1 wherein the plastic sections are vacuum formed and have a thickness from 0.035" to 0.106".

5. The invention defined by claim 1 in which the plastic sections are vacuum formed of high impact styrene having a thickness from 0.035" to 0.106".

6. The invention of claim 1 wherein when the superjacent section is reversed end-for-end into said operative position the posts of the subjacent section are misaligned with the posts of the superjacent section whereby the superjacent section is supported on the posts of the subjacent section with the base of the superjacent section spaced from the bunks of the subjacent section such that products received and supported on the bunks of the subjacent section are disposed out of contact with the superjacent section.

7. The invention defined by claim 1 wherein said cooperating engaging surfaces comprise upwardly facing shoulders on the posts and downwardly facing shoulders on the hollow base.

* * * * *